US010923067B2

(12) United States Patent
Lee et al.

(10) Patent No.: US 10,923,067 B2
(45) Date of Patent: Feb. 16, 2021

(54) DISPLAY DEVICE AND A METHOD OF DRIVING THE SAME

(71) Applicant: SAMSUNG DISPLAY CO, LTD., Yongin-si (KR)

(72) Inventors: Sujin Lee, Hanam-si (KR); Kihyun Pyun, Gwangmyeong-si (KR); Keunoh Kang, Uijeongbu-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 71 days.

(21) Appl. No.: 16/216,158

(22) Filed: Dec. 11, 2018

(65) Prior Publication Data

US 2019/0180709 A1 Jun. 13, 2019

(30) Foreign Application Priority Data

Dec. 12, 2017 (KR) ..... 10-2017-0170507

(51) Int. Cl.

| | |
|---|---|
| ***G09G 5/00*** | (2006.01) |
| ***G09G 3/36*** | (2006.01) |
| ***G09G 3/20*** | (2006.01) |

(52) U.S. Cl.

CPC ..... *G09G 3/3688* (2013.01); *G09G 3/20* (2013.01); *G09G 3/3611* (2013.01); *G09G 3/3681* (2013.01); *G09G 2310/0213* (2013.01); *G09G 2310/0267* (2013.01); *G09G 2310/0272* (2013.01); *G09G 2310/0286* (2013.01); *G09G 2310/08* (2013.01); *G09G 2330/026* (2013.01)

(58) Field of Classification Search

None

See application file for complete search history.

(56) References Cited

U.S. PATENT DOCUMENTS

| | | | | |
|---|---|---|---|---|
| 6,825,893 | B2 | 11/2004 | Choi | |
| 7,009,673 | B2 | 3/2006 | Matsumoto et al. | |
| 7,939,829 | B2 | 5/2011 | Sakai | |
| 8,071,977 | B2 | 12/2011 | Heo et al. | |
| 2009/0283762 | A1 | 11/2009 | Kimura | |
| 2011/0292024 | A1 * | 12/2011 | Baek ..... | G09G 3/2096 345/212 |

(Continued)

FOREIGN PATENT DOCUMENTS

| | | |
|---|---|---|
| KR | 10-0274799 | 2/2001 |
| KR | 10-2007-0103620 | 10/2007 |

(Continued)

*Primary Examiner* — Carl Adams

(74) *Attorney, Agent, or Firm* — F. Chau & Associates, LLC

(57) ABSTRACT

A display device includes a display panel including a plurality of pixels, a gate driver configured to provide gate signals to the plurality of pixels, a data driver configured to generate a first initialization completion signal, and to provide data signals to the plurality of pixels, and a controller configured to generate a second initialization completion signal in response the first initialization completion signal and a state signal, and to control the gate driver and the data driver in response to the second initialization completion signal. The first initialization completion signal is activated when an initialization operation of the data driver is completed, and the state signal is activated when an initialization operation of the controller is completed.

20 Claims, 11 Drawing Sheets

(56) References Cited

U.S. PATENT DOCUMENTS

2013/0113777 A1* 5/2013 Baek ..... G09G 3/20
345/212

FOREIGN PATENT DOCUMENTS

| | | |
|---|---|---|
| KR | 1020090060473 | 6/2009 |
| KR | 1020120067433 | 6/2012 |
| KR | 1020140028444 | 3/2014 |
| KR | 1020160072339 | 6/2016 |
| KR | 1020170038479 | 4/2017 |
| KR | 1020170081047 | 7/2017 |

* cited by examiner

DISPLAY DEVICE AND A METHOD OF DRIVING THE SAME

CROSS-REFERENCE TO RELATED APPLICATION

This application claims priority under 35 U.S.C. § 119 to Korean Patent Application No. 10-2017-0170507, filed on Dec. 12, 2017 in the Korean Intellectual Property Office (KIPO), the disclosure of which is incorporated by reference herein in its entirety.

TECHNICAL FIELD

Exemplary embodiments of the present inventive concept relate to display devices, and more particularly, to display devices controlling power-on sequences, and a method of driving the display devices.

DISCUSSION OF RELATED ART

A display device generally includes a display panel and a panel driver. The display panel may include a plurality of pixels. The panel driver may include a gate driver for providing gate signals to the pixels, a data driver for providing data signals to the pixels, and a timing controller for controlling the gate driver and the data driver.

In general, components (e.g., the timing controller, a power management circuit, the gate driver, the data driver, etc.) of the panel driver have their respective power-on sequences. To synchronize the power-on sequences with one another, delay times for various signals may be set using register values. However, if a delay register value is not properly set, the power-on sequences may not be synchronized, and an abnormal image may be displayed during an initial driving period.

SUMMARY

According to an exemplary embodiment of the present inventive concept, a display device includes a display panel including a plurality of pixels, a gate driver configured to provide gate signals to the plurality of pixels, a data driver configured to generate a first initialization completion signal, and to provide data signals to the plurality of pixels, and a controller configured to generate a second initialization completion signal in response to the first initialization completion signal and a state signal, and to control the gate driver and the data driver in response to the second initialization completion signal. The first initialization completion signal is activated when an initialization operation of the data driver is completed, and the state signal is activated when an initialization operation of the controller is completed.

In an exemplary embodiment of the present inventive concept, the data driver may provide the data signals to the plurality of pixels after the second initialization completion signal is activated, and the controller may provide a first control signal to the gate driver after the second initialization completion signal is activated.

In an exemplary embodiment of the present inventive concept, the state signal may include at least one of a first signal representing that a value of a setting register is loaded, a second signal representing that correction data for correcting input image data are loaded, or a third signal representing that an input voltage reaches a target voltage.

In an exemplary embodiment of the present inventive concept, the controller may include a first signal generator configured to output a ready signal in response to the first signal, the second signal, the third signal, and the first initialization completion signal, a delay circuit configured to generate the second initialization completion signal by delaying the ready signal, and a first signal controller configured to output the first control signal to the gate driver after the second initialization completion signal is activated.

In an exemplary embodiment of the present inventive concept, the first signal generator may include a first AND gate configured to generate a first enable signal by performing an AND operation on the first signal and the second signal, a first comparator configured to generate the third signal by comparing the input voltage and the target voltage, a second AND gate configured to generate a second enable signal by performing an AND operation on the first enable signal and the third signal, and a third AND gate configured to generate the ready signal by performing an AND operation on the second enable signal and the first initialization completion signal.

In an exemplary embodiment of the present inventive concept, while the second initialization completion signal is in an inactive state, the first signal controller may deactivate, as the first control signal, at least one of a vertical start signal or a gate clock signal.

In an exemplary embodiment of the present inventive concept, the display device may further include a power supply configured to adjust the input voltage to reach the target voltage using a resistor string.

In an exemplary embodiment of the present inventive concept, the controller may provide a second control signal to the data driver. The data driver may include a second signal generator configured to generate the first initialization completion signal in response to a start frame control signal for recovering a reference clock signal and an operating flag signal representing an operating state of the data driver, a second signal controller configured to control outputting the second control signal in response to the second initialization completion signal, and a data driving circuit configured to generate the data signals in response to the second control signal received from the second signal controller.

In an exemplary embodiment of the present inventive concept, while the second initialization completion signal is in an inactive state, the second signal controller may deactivate, as the second control signal, at least one of a horizontal start signal, a data clock signal, or a load signal.

In an exemplary embodiment of the present inventive concept, the second signal generator may include a control interface configured to communicate with the controller, and to output the operating flag signal and the second control signal, a NOR gate configured to generate a third enable signal by performing a NOR operation on the start frame control signal and the operating flag signal, and a flip-flop configured to activate the first initialization completion signal when the third enable signal is activated.

According to an exemplary embodiment of the present inventive concept, a display device includes a display panel including a plurality of pixels, a gate driver configured to provide gate signals to the plurality of pixels, a data driver configured to generate a first initialization completion signal when an initialization operation of the data driver is completed, and to provide data signals to the plurality of pixels, and a controller configured to generate a second initialization completion signal in response to the first initialization completion signal and a state signal, and to control the gate driver and the data driver in response to the second initialization completion signal. The data driver blocks the data signals while the second initialization completion signal is in an inactive state.

According to an exemplary embodiment of the present inventive concept, in a method of driving a display device, a data driver generates a first initialization completion signal when an initialization operation of the data driver is completed, a controller generates a second initialization completion signal in response to the first initialization completion signal and a state signal that is activated when an initialization operation of the controller is completed, and the controller provides a first control signal to the gate driver after the second initialization completion signal is activated.

In an exemplary embodiment of the present inventive concept, the data driver may output data signals after the second initialization completion signal is activated.

In an exemplary embodiment of the present inventive concept, to output the data signals, outputting of a second control signal may be blocked while the second initialization completion signal is in an inactive state, and the data signals may be output in response to the second control signal that is output when the second initialization completion signal is activated.

In an exemplary embodiment of the present inventive concept, the second control signal may include at least one of a horizontal start signal, a data clock signal, or a load signal.

In an exemplary embodiment of the present inventive concept, the state signal may include at least one of a first signal representing that a value of a setting register is loaded, a second signal representing that correction data for correcting input image data are loaded, or a third signal representing that an input voltage reaches a target voltage.

In an exemplary embodiment of the present inventive concept, to generate the second initialization completion signal, a ready signal may be generated in response to the first signal, the second signal, the third signal, and the first initialization completion signal, and the ready signal may be delayed to generate the second initialization completion signal.

In an exemplary embodiment of the present inventive concept, to generate the ready signal, a first enable signal may be generated by performing an AND operation on the first signal and the second signal, the third signal may be generated by comparing the input voltage and the target voltage, a second enable signal may be generated by performing an AND operation on the first enable signal and the third signal, and the ready signal may be generated by performing an AND operation on the second enable signal and the first initialization completion signal.

In an exemplary embodiment of the present inventive concept, the first initialization completion signal may be generated in response to a start frame control signal for recovering a reference clock signal and an operating flag signal.

In an exemplary embodiment of the present inventive concept, the first control signal may include at least one of a vertical start signal or a gate clock signal.

BRIEF DESCRIPTION OF THE DRAWINGS

The above and other features of the present inventive concept will be more clearly understood by describing in detail exemplary embodiments thereof with reference to the accompanying drawings.

DETAILED DESCRIPTION OF THE EMBODIMENTS

Figure 1:
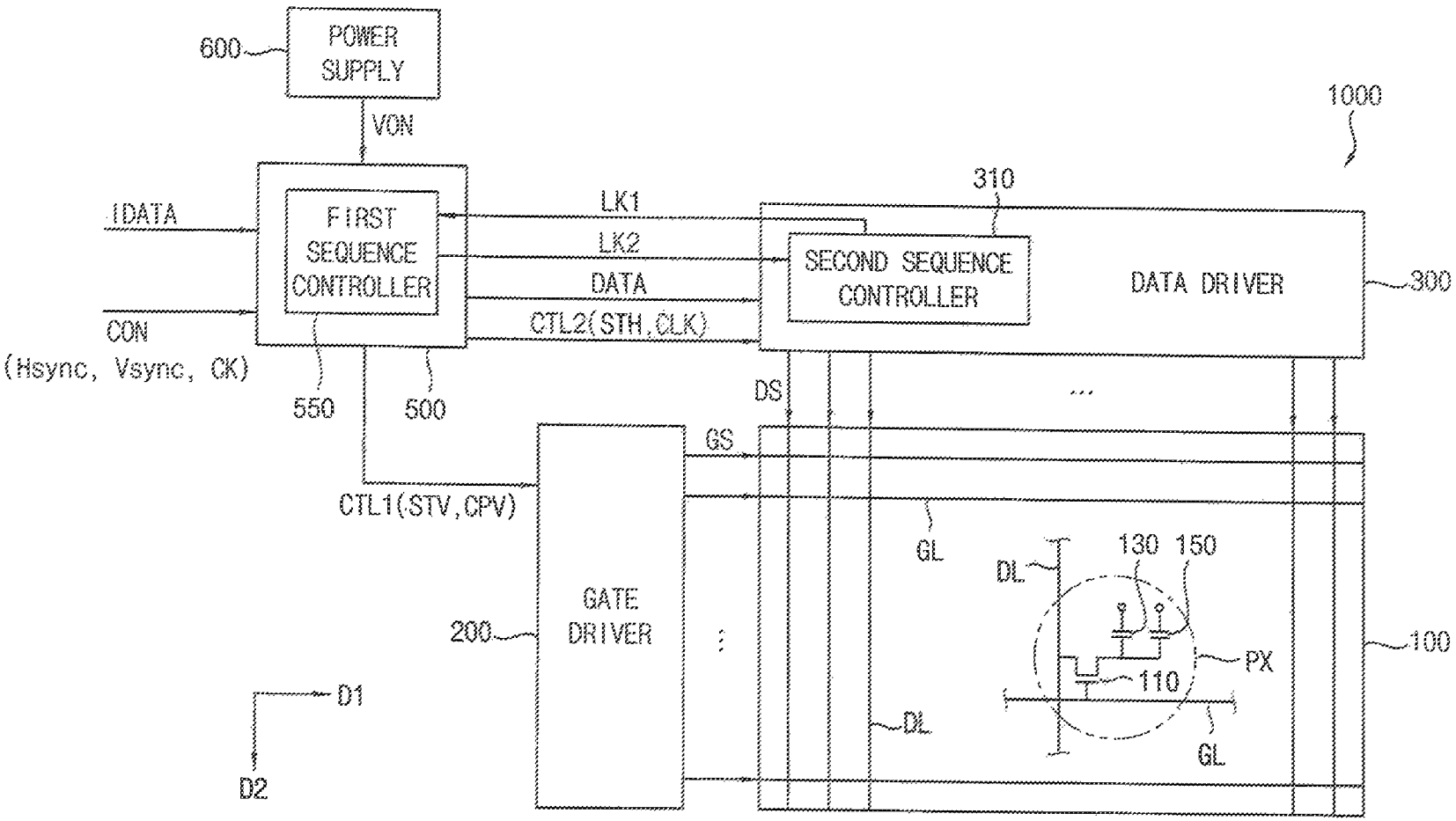
FIG. 1 is a block diagram illustrating a display device according to an exemplary embodiment of the present inventive concept.

Exemplary embodiments of the present inventive concept provide a display device that is automatically controlled to comply with a power-on sequence.

Exemplary embodiments of the present inventive concept also provide a method of driving the display device.

Hereinafter, exemplary embodiments of the present inventive concept will be explained in detail with reference to the accompanying drawings. Like reference numerals may refer to like elements throughout this application.

FIG. 1 is a block diagram illustrating a display device according to an exemplary embodiment of the present inventive concept.

Referring to FIG. 1, a display device 1000 may include a display panel 100, a gate driver 200, a data driver 300, and a timing controller 500. In an exemplary embodiment of the present inventive concept, the display device 1000 may further include a power supply 600 supplying an input voltage VON.

The display panel 100 may display an image corresponding to data signals DS that are generated based on image data DATA from the timing controller 500. The display panel 100 may include gate lines GL, data lines DL, and a plurality of pixels PX. The gate lines GL may extend in a first direction D1, and may be disposed along a second direction D2 perpendicular to the first direction D1. The data lines DL may extend in the second direction D2, and may be disposed along the first direction D1. Each of the pixels PX may include a thin film transistor 110 connected to the gate line GL and the data line DL, and liquid crystal and storage capacitors 130 and 150 connected to the thin film transistor 110.

The gate driver 200, the data driver 300, and the timing controller 500 may form a panel driver that drives the display panel 100.

The gate driver 200 may generate gate signals GS in response to a vertical start signal STV and a gate clock signal CPV provided from the timing controller 500, and may output the gate signals GS to the gate lines GL.

The data driver 300 may output the data signals DS to the data lines DL in response to a horizontal start signal STH and a data clock signal CLK provided from the timing controller 500.

The data driver 300 may include a second sequence controller 310 for controlling a power-on sequence by interworking with the timing controller 500. The second sequence controller 310 may generate a first initialization completion signal LK1 when internal signals of the data driver 300 are stabilized (or when an initialization operation of the data driver 300 is completed), and may provide the first initialization completion signal LK1 to a first sequence controller 550 of the timing controller 500. Further, the second sequence controller 310 may control signals (e.g., a second control signal CTL2) for the data driver 300 to provide data signals DS to the pixels PX after a second initialization completion signal LK2 from the first sequence controller 550 is activated. However, while the second initialization completion signal LK2 is in an inactive state, the second sequence controller 310 may block the data signals DS so that they are not provided to the pixels PX.

The timing controller 500 may receive an input image data IDATA and a control signal CON from an external device. The control signal CON may include a horizontal synchronization signal Hsync, a vertical synchronization signal Vsync, and a clock signal CK. The timing controller 500 may generate image data DATA, e.g., in digital form suitable for the data driver 300, based on the input image data IDATA, and may provide the image data DATA to the data driver 300. The timing controller 500 may generate the horizontal start signal STH based on the horizontal synchronization signal Hsync, and may provide the horizontal start signal STH to the data driver 300. The timing controller 500 may generate the vertical start signal STV based on the vertical synchronization signal Vsync, and may provide the vertical start signal STV to the gate driver 200. The timing controller 500 may generate the gate clock signal CPV and the data clock signal CLK by using the clock signal CK, may output the gate clock signal CPV to the gate driver 200, and may output the data clock signal CLK to the data driver 300. In an exemplary embodiment of the present inventive concept, the data clock signal CLK may be embedded in the image data DATA.

The timing controller 500 may include the first sequence controller 550 for controlling the power-on sequence by interworking with the data driver 300. The first sequence controller 550 may determine whether components of the display device 1000 are stabilized, and may activate the second initialization completion signal LK2 after the components are stabilized. In an exemplary embodiment of the present inventive concept, the first sequence controller 550 may determine that the data driver 300 is in a stable state if the first initialization completion signal LK1 from the second sequence controller 310 is activated. The first sequence controller 550 may activate the second initialization completion signal LK2 based on the first initialization completion signal LK1 and a state signal that is activated when internal signals of the timing controller 500 are stabilized (or when an initialization operation of a controller is completed).

Further, the timing controller 500 may provide a first control signal CTL1 to the gate driver 200 after the second initialization completion signal LK2 is activated. For example, if the second initialization completion signal LK2 is activated, the timing controller 500 may provide the first control signal CTL1 including the vertical start signal STV and the gate clock signal CPV to the gate driver 200 to normally operate the gate driver 200. However, while the second initialization completion signal LK2 is in the inactive state, the timing controller 500 may inactivate or deactivate at least one of the vertical start signal STV and the gate clock signal CPV so that the gate driver 200 does not output the gate signals GS.

Although FIG. 1 illustrates an example where the first sequence controller 550 is included in the timing controller 500, in an exemplary embodiment of the present inventive concept, the first sequence controller 550 may be implemented as a separate circuit outside the timing controller 500.

Figure 2:
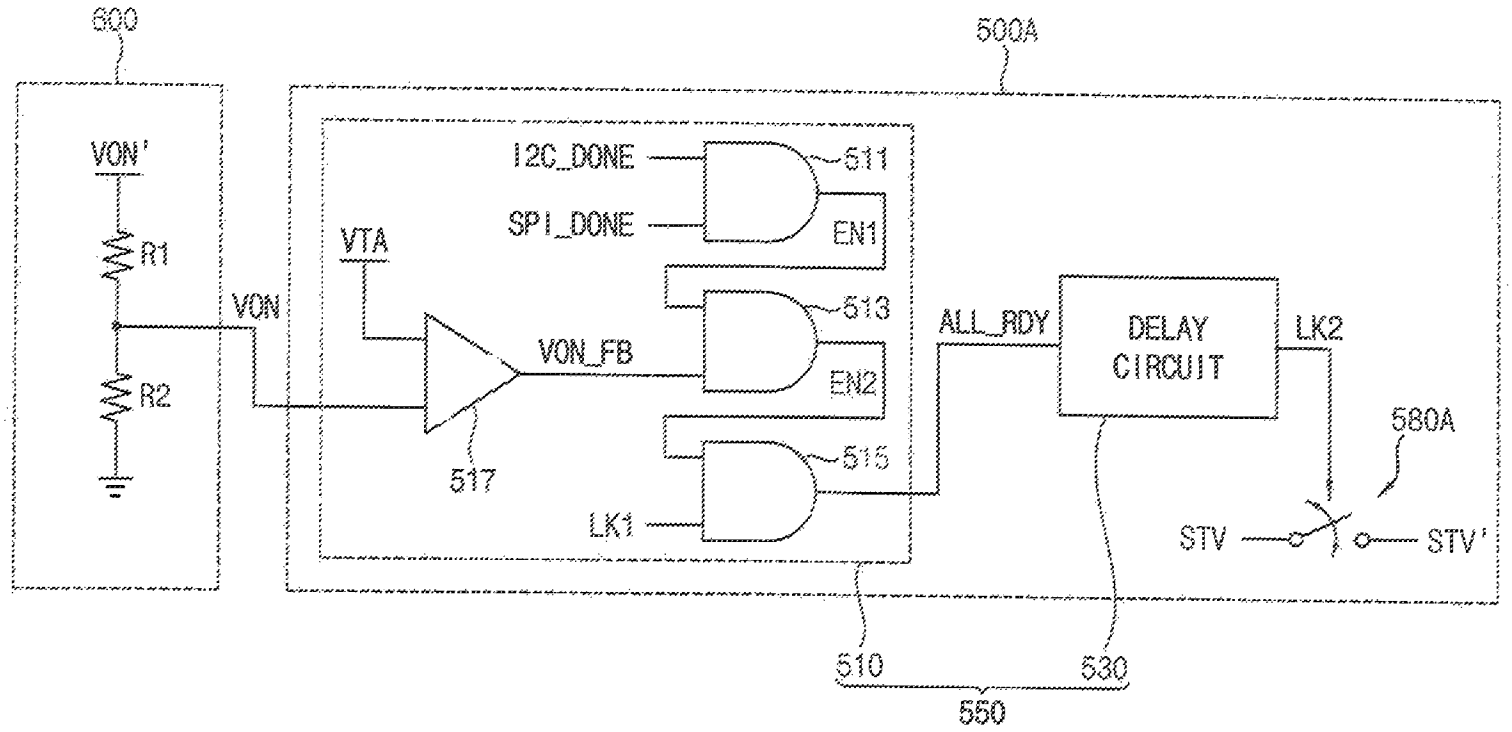
FIG. 2 is a diagram illustrating a first sequence controller included in the display device of FIG. 1 according to an exemplary embodiment of the present inventive concept.

FIG. 2 is a diagram illustrating a first sequence controller included in the display device of FIG. 1 according to an exemplary embodiment of the present inventive concept.

Referring to FIG. 2, the first sequence controller 550 of a timing controller 500A may control signals to comply with a power-on sequence by interworking with a data driver. The first sequence controller 550 may include a first signal generator 510 and a delay circuit 530.

The first signal generator 510 may output a ready signal ALL_RDY based on a state signal and the first initialization completion signal LK1. The state signal may include at least one of a first signal I2C_DONE, a second signal SPI_DONE, or a third signal VON_FB. Here, the first signal I2C_DONE may represent that a value of a setting register is loaded. For example, the first signal I2C_DONE may represent where a setting value for the timing controller 500A, a setting value for a power supply 600, or the like are loaded from an electrically erasable programmable read-only memory (EEPROM). The second signal SPI_DONE may represent that correction data for correcting input image data are loaded. For example, the second signal SPI_DONE may represent the correction data, including correction values according to pixels and gray levels for correcting luminance non-uniformity of a display panel, are loaded from a flash memory. The third signal VON_FB may represent that the input voltage VON reaches a target voltage VTA suitable for the timing controller 500A.

In an exemplary embodiment of the present inventive concept, the first signal generator 510 may include a first AND gate 511, a second AND gate 513, a third AND gate 515, and a first comparator 517. The first AND gate 511 may generate a first enable signal EN1 by performing an AND operation on the first signal I2C_DONE and the second signal SPI_DONE. The first comparator 517 may generate the third signal VON_FB by comparing the input voltage VON and the target voltage VTA. The second AND gate 513 may generate a second enable signal EN2 by performing an AND operation on the first enable signal EN1 and the third signal VON_FB. The third AND gate 515 may generate the ready signal ALL_RDY by performing an AND operation on the second enable signal EN2 and the first initialization completion signal LK1.

In an exemplary embodiment of the present inventive concept, the input voltage VON may be generated by adjusting a first voltage VON' by an external circuit (e.g., the power supply 600). For example, in the power supply 600

(e.g., a DC-DC converter), the first voltage VON' may be adjusted to reach the target voltage VTA suitable for the timing controller 500A by using a resistor string including resistors R1 and R2 connected in series, and the adjusted input voltage VON may be provided to the timing controller 500A.

The delay circuit 530 may delay the ready signal ALL_RDY to increase stability of the power-on sequence. The delay circuit 530 may generate a second initialization completion signal LK2 by delaying the ready signal ALL_RDY. For example, the delay circuit 530 may include a capacitor for delaying signal outputting.

The timing controller 500A may further include a first signal controller 580A for outputting a first control signal (e.g., a vertical start signal STV') to a gate driver after the second completion signal LK2 is activated. For example, while the second completion signal LK2 is in an inactive state, the first signal controller 580A may turn off a switch such that the vertical start signal STV is not output as the first control signal CTL1. If the second completion signal LK2 is activated, the first signal controller 580A may turn on the switch such that the vertical start signal STV is output as the first control signal CTL1.

Although FIG. 2 illustrates an example where the first signal generator 510 includes the first AND gate 511, the second AND gate 513, the third AND gate 515, and the first comparator 517, a configuration of the first signal generator 510 may not be limited thereto. The first signal generator 510 may have various configurations capable of outputting the ready signal ALL_RDY based on the first through third signals I2C_DONE, SPI_DONE, and VON_FB and the first initialization completion signal LK1.

Figure 3:
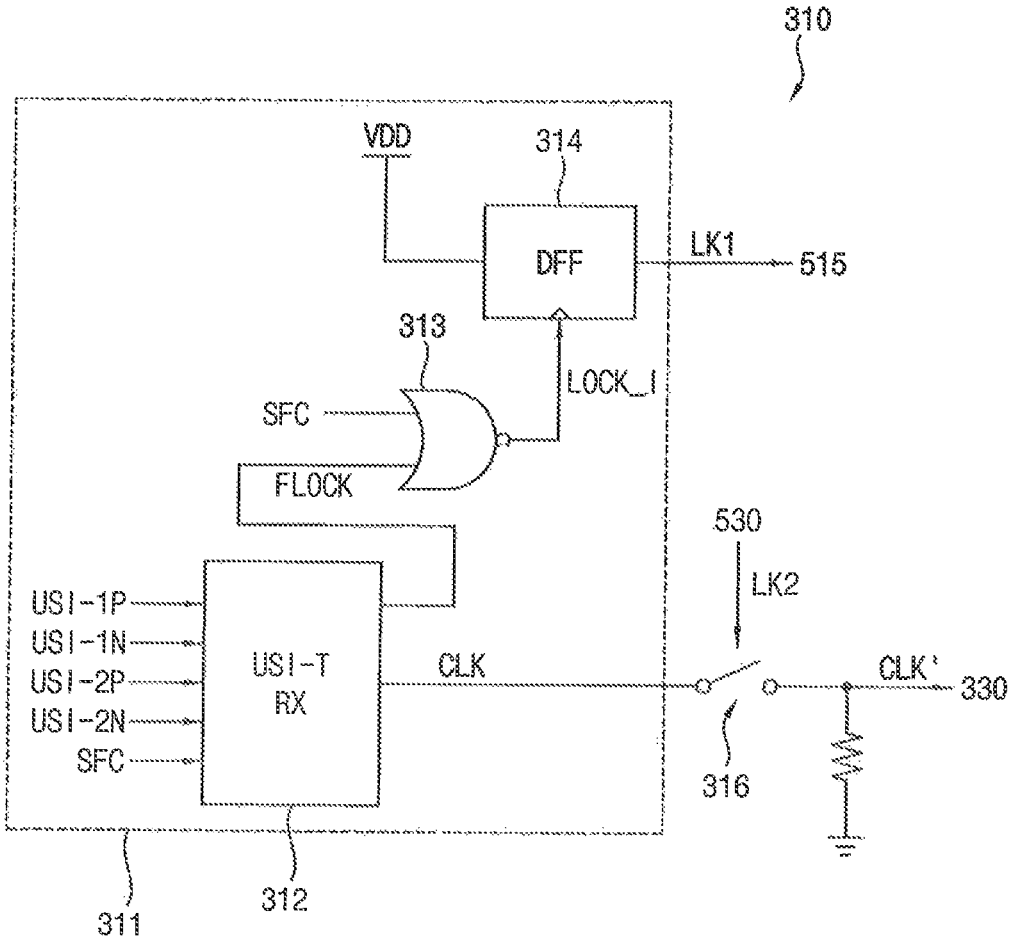
FIG. 3 is a diagram illustrating a second sequence controller included in the display device of FIG. 1 according to an exemplary embodiment of the present inventive concept.

FIG. 3 is a diagram illustrating a second sequence controller included in the display device of FIG. 1 according to an exemplary embodiment of the present inventive concept.

Referring to FIG. 3, the second sequence controller 310 of a data driver may control signals to comply with a power-on sequence by interworking with a timing controller (e.g., the timing controller 500 of FIG. 1). The second sequence controller 310 may include a second signal generator 311 and a second signal controller 316.

The second signal generator 311 may generate the first initialization completion signal LK1 based on a start frame control signal SFC for recovering a reference clock signal and an operating flag signal FLOCK representing an operating state of the data driver.

In an exemplary embodiment of the present inventive concept, the second signal generator 311 may include a control interface 312, a NOR gate 313, and a flip-flop 314.

The control interface 312 may communicate with the timing controller, and may output the operating flag signal FLOCK and a second control signal (e.g., the data clock signal CLK). For example, the control interface 312 may be an interface between the timing controller and the data driver, and may be connected to the timing controller in a unified standard interface for TV (USI-T) manner through pins (e.g., USI-1P, USI-1N, USI-2P, USI-2N, or the like). In this case, the control interface 312 may be a USI-T receiver (USI-T RX).

The NOR gate 313 may generate a third enable signal LOCK_I by performing a NOR operation on the start frame control signal SFC and the operating flag signal FLOCK. Here, the start frame control signal SFC may be a control signal for clock training which determines a period in which an internal clock signal is trained. For example, the start frame control signal SFC may be received from the timing controller. In the interface between the timing controller and the data driver, various setting data may be received during a lower period of the start frame control signal SFC (or during a vertical blank period). For example, the data driver may receive a setting value for recovering an internal reference clock during the vertical blank period, and a clock data recovery operation of the data driver may be performed. Thus, the start frame control signal SFC may be used, per the vertical blank period, to inform the data driver of the recovery operation for the reference clock signal of the data driver. The operating flag signal FLOCK may be a flag for representing a stable state of internal signals of the data driver. For example, the operating flag signal FLOCK may have a low level at a time point when a reference clock used in the data driver normally operates (or has a normal waveform).

The flip-flop 314 may activate the first initialization completion signal LK1 when the third enable signal LOCK_I is activated.

The second signal controller 316 may control outputting the second control signal (e.g., the data clock signal CLK) based on the second initialization completion signal LK2. In an exemplary embodiment of the present inventive concept, while the second initialization completion signal LK2 is in an inactive state, the second signal controller 316 may deactivate, as the second control signal, at least one of the horizontal start signal STH, the data clock signal CLK, or a load signal TP. Accordingly, while the second initialization completion signal LK2 is in the inactive state, the second signal controller 316 may control a data driving circuit 330 not to output data signals. However, if the initialization completion signal LK2 is activated after the data driver and the timing controller are stabilized, the second signal controller 316 may provide the second control signal to the data driving circuit 330 to normally provide the data signals to a display panel.

Figure 4:
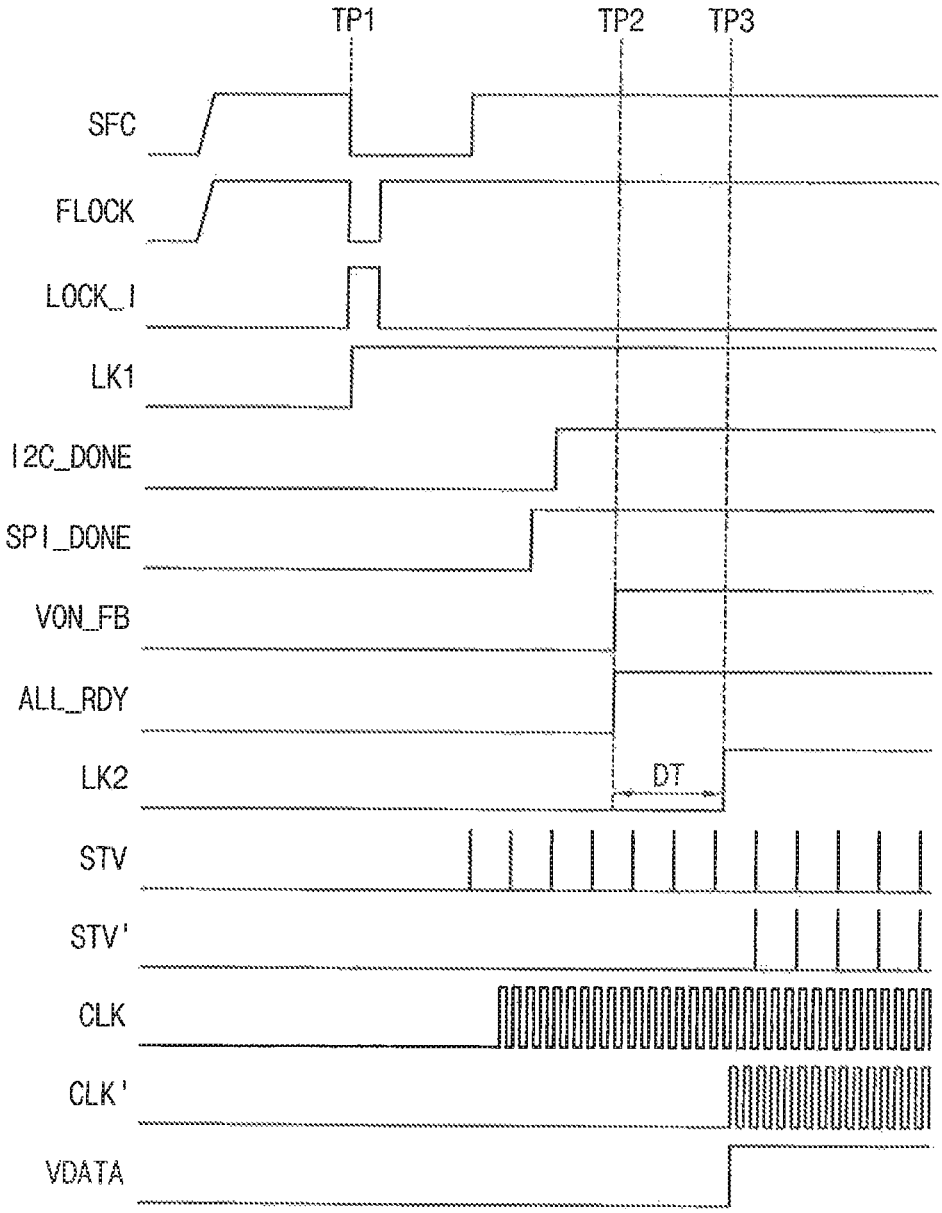
FIG. 4 is a timing diagram illustrating a power-on sequence controlled by a first sequence controller and a second sequence controller included in the display device of FIG. 1 according to an exemplary embodiment of the present inventive concept.

FIG. 4 is a timing diagram illustrating a power-on sequence controlled by a first sequence controller and a second sequence controller included in the display device of FIG. 1 according to an exemplary embodiment of the present inventive concept.

Referring to FIGS. 2 through 4, a power-on sequence of a display device may be sequentially performed by a first sequence controller (e.g., 550) and a second sequence controller (e.g., 310).

At a first time point TP1, the start frame control signal SFC and the operating flag signal FLOCK may have low levels, and the NOR gate 313 may activate the third enable signal LOCK_I by performing a NOR operation on the start frame control signal SFC and the operating flag signal FLOCK. The flip-flop 314 may receive the activated third enable signal LOCK_I, and may activate the first initialization completion signal LK1. After the first time point TP1, the first initialization completion signal LK1 may be maintained at a high level.

At a second time point TP2, not only the first initialization completion signal LK1 but also the first signal I2C_DONE, the second signal SPI_DONE, and the third signal VON_FB may be in active states, and thus, the ready signal ALL_RDY may be activated. The ready signal ALL_RDY may be delayed by a delay time DT by the delay circuit 530.

Although the vertical start signal STV and the data clock signal CLK are generated in a timing controller before a third time point TP3, the vertical start signal STV and the data clock signal CLK may not be output to a gate driver and a data driver while the second initialization completion signal LK2 is in an inactive state.

At the third time point TP3, the delayed ready signal ALL_RDY, or the activated second initialization completion signal LK2, may be output from the delay circuit 530. Accordingly, after the third time point TP3, the vertical start signal STV' and the data clock signal CLK' may be provided to the gate driver and the data driver, respectively. After the third time point TP3, to drive a display panel, the gate driver may provide gate signals to pixels, and the data driver may provide data signals VDATA to the pixels.

Accordingly, the display device may drive the display panel after checking that the timing controller and the data driver are stabilized, and an abnormal display phenomenon may be prevented.

Figure 5:
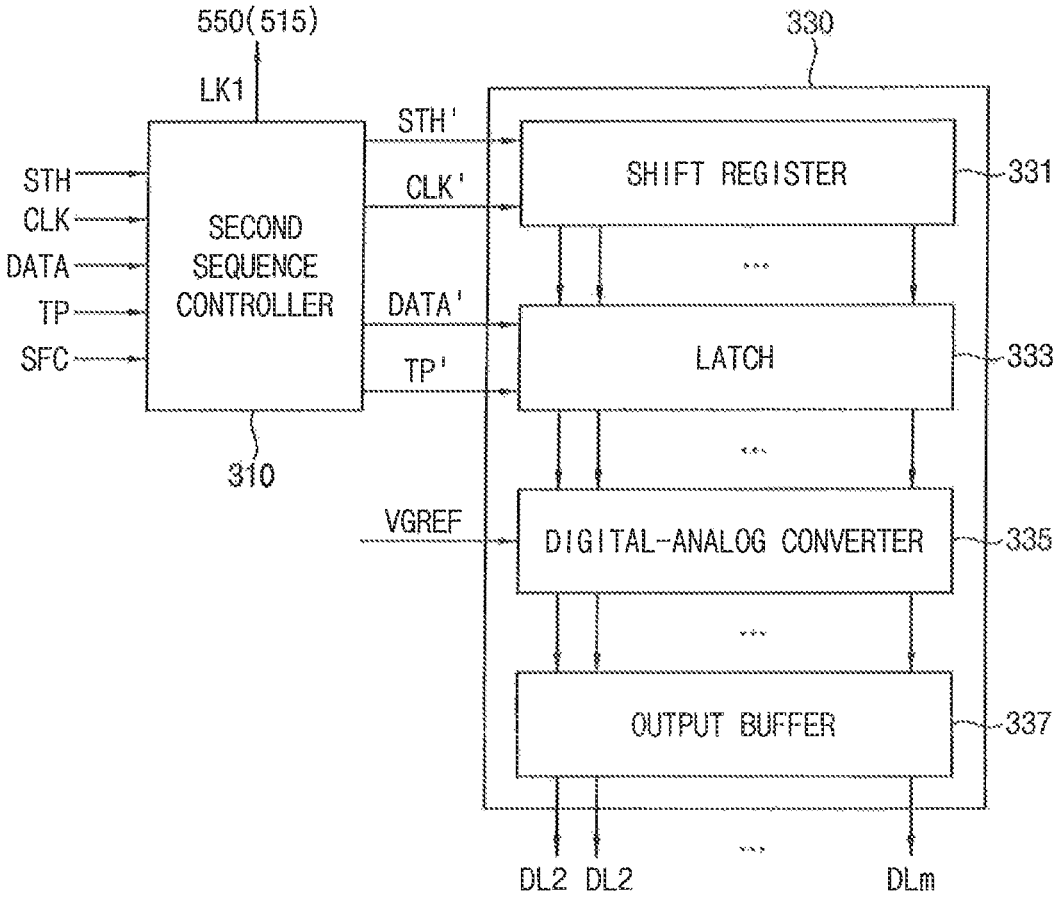
FIG. 5 is a block diagram illustrating a data driver included in the display device of FIG. 1 according to an exemplary embodiment of the present inventive concept.

FIG. 5 is a block diagram illustrating a data driver included in the display device of FIG. 1 according to an exemplary embodiment of the present inventive concept.

Referring to FIG. 5, the data driving circuit 330 may generate analog data signals based on image data DATA' and second control signals (e.g., STH', CLK', etc.). At least one of the image data DATA' or the second control signals (e.g., STH', CLK', etc.) may be provided to the data driving circuit 330 via the second sequence controller 310, and thus the data driving circuit 330 may provide the data signals after a timing controller and a data driver are stabilized. In an exemplary embodiment of the present inventive concept, the data driving circuit 330 may include a shift register 331, a latch 333, a digital-analog converter 335, and an output buffer 337.

The shift register 331 may receive a horizontal start signal STH' and a data clock signal CLK'. The shift register 331 may generate a sampling signal by shifting the horizontal start signal STH' in synchronization with the data clock signal CLK'.

The latch 333 may latch the image data DATA' in response to the sampling signal. The latch 333 may output the latched image data DATA' in response to a load signal TP'.

The digital-analog converter 335 may convert the image data DATA' output from the latch 333 into data signals based on a gamma reference voltage VGREF.

The output buffer 337 may output the data signals to data lines DL1, DL2, . . . and DLm.

Although FIG. 5 illustrates an example where the data driving circuit 330 includes the shift register 331, the latch 333, the digital-analog converter 335, and the output buffer 337, a configuration of the data driving circuit 330 may not be limited thereto. The data driving circuit 330 may have various configurations that convert the image data DATA' into the data signals while outputting the data signals as controlled by the second sequence controller 310.

Figure 6:
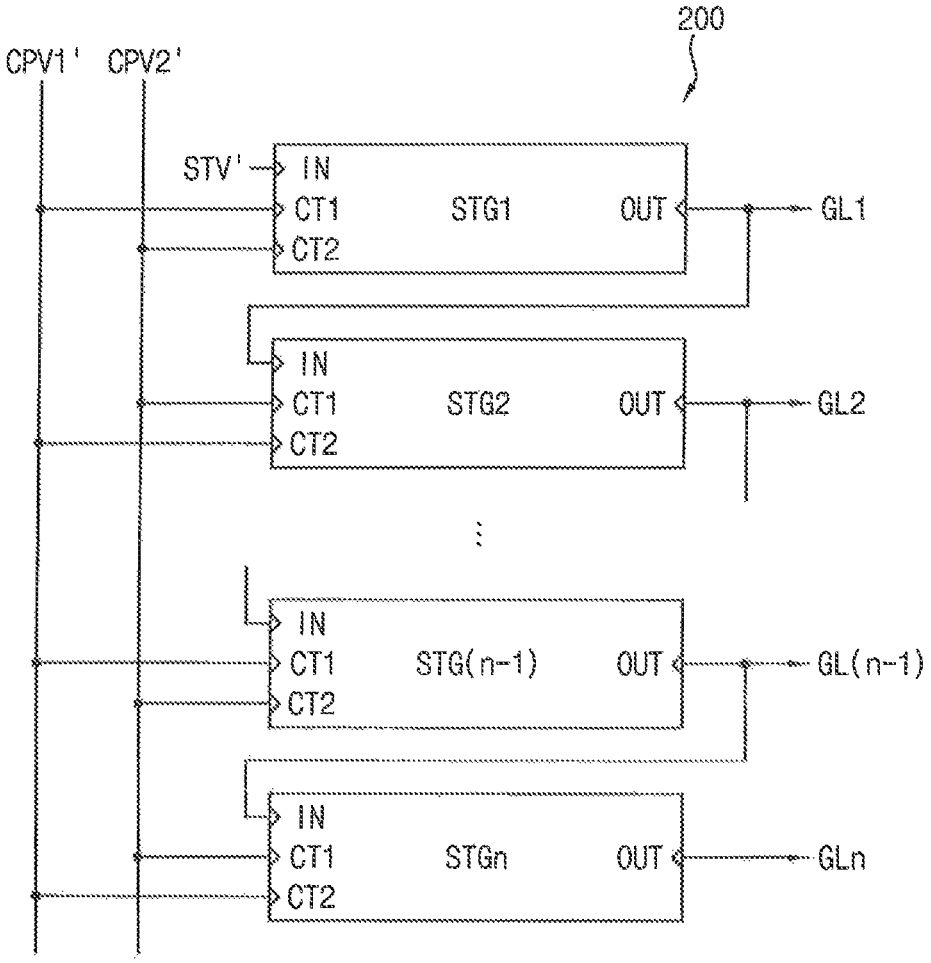
FIG. 6 is a block diagram illustrating a gate driver included in the display device of FIG. 1 according to an exemplary embodiment of the present inventive concept.

FIG. 6 is a block diagram illustrating a gate driver included in the display device of FIG. 1 according to an exemplary embodiment of the present inventive concept.

Referring to FIG. 6, the gate driver 200 may include a plurality of stages STG1, STG2, . . . STG(n−1), and STGn. Each of the stages STG1, STG2, . . . STG(n−1), and STGn may include an input terminal IN, a first clock terminal CT1, a second clock terminal CT2, and an output terminal OUT.

A first gate clock signal CPV1' and a second gate clock signal CPV2' having different timings or phases may be applied to the first clock terminal CT1 and the second clock terminal CT2 of each of the stages STG1, STG2, . . . STG(n−1), and STGn. For example, the second gate clock signal CPV2' may be an inversion signal inverted from the first gate clock signal CPV1'. With respect to adjacent stages, the first gate clock signal CPV1' and the second gate clock signal CPV2' may be applied in an opposite order. For example, the first gate clock signal CPV1' may be applied to the first clock terminal CT1 of an odd-numbered stage (e.g., STG1), and the second gate clock signal CPV2' may be applied to the second clock terminal CT2 of the odd-numbered stage (e.g., STG1). In contrast, the first gate clock signal CPV1' may be applied to the second clock terminal CT2 of an even-numbered stage (e.g., STG2), and the second gate clock signal CPV2' may be applied to the first clock terminal CT1 of the even-numbered stage (e.g., STG2).

The vertical start signal STV' or an output signal from a previous stage may be applied to the input terminal IN of each of the stages STG1, STG2, . . . STG(n−1), and STGn. For example, the vertical start signal STV' may be applied to the input terminal IN of a first stage STG1, and the output signal from the previous stage may be applied to the input terminal IN of each of the remaining stages STG2, . . . STG(n−1), and STGn. At the output terminals OUT of the stages STG1, STG2, . . . STG(n−1), and STGn, gate signals may be output to gate lines GL1, GL2, . . . GL(n−1), and GLn.

Figure 7:
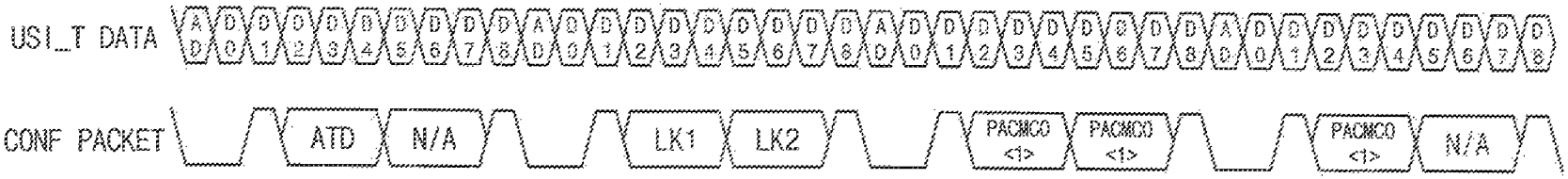
FIGS. 7 and 8 are diagrams for describing a communication method between a controller and a data driver included in the display device of FIG. 1 according to an exemplary embodiment of the present inventive concept.
Figure 8:
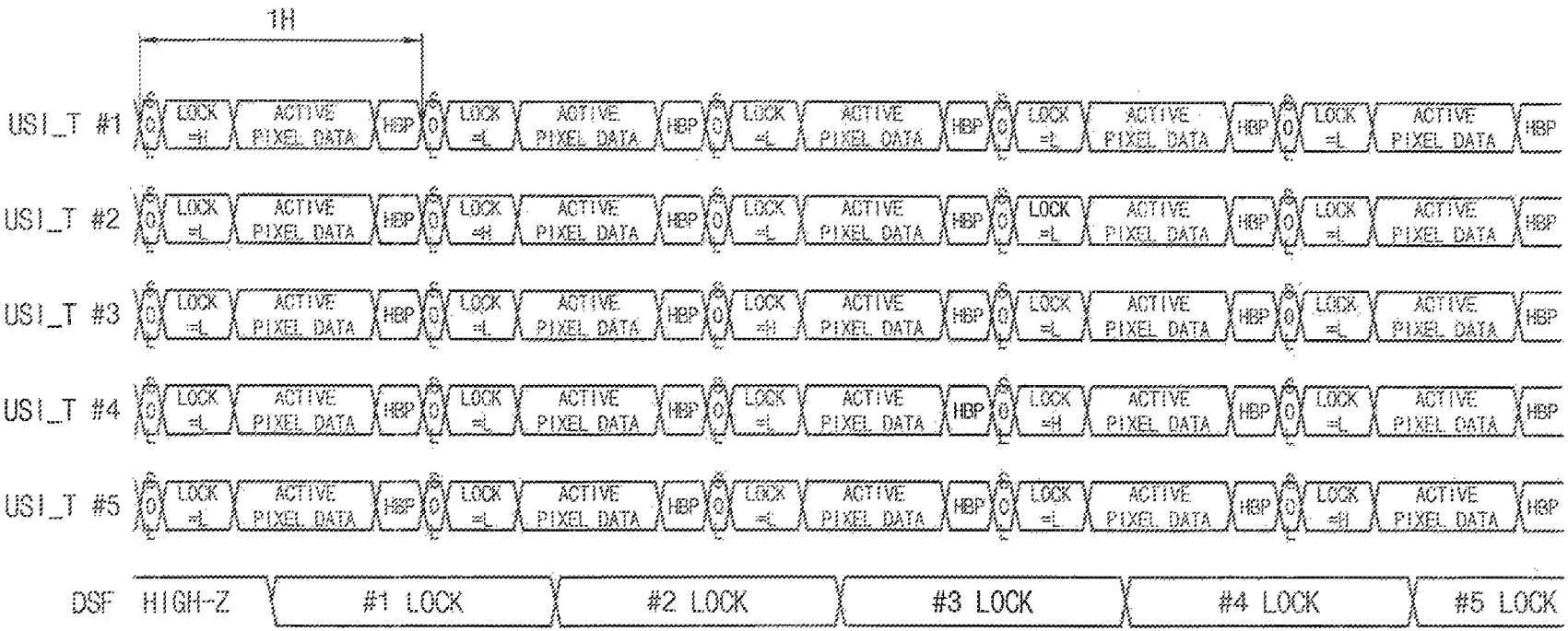

FIGS. 7 and 8 are diagrams for describing a communication method between a controller and a data driver included in the display device of FIG. 1 according to an exemplary embodiment of the present inventive concept.

Referring to FIGS. 7 and 8, in a protocol between a timing controller and a data driver, the first initialization completion signal LK1 and the second initialization completion signal LK2 may be allocated in a portion of a configuration packet CONF PACKET, and thus the first and seconds initialization completion signals LK1 and LK2 may be transferred without an additional line.

As illustrated in FIG. 7, between the timing controller and the data driver, not only image data and control signals, but also configuration data, such as a temperature of a driving chip, may be transferred. For example, in the protocol between the timing controller and the data driver, the first initialization completion signal LK1 and the second initialization completion signal LK2 may be allocated in a portion of the configuration packet CONF PACKET, and thus the first and second initialization completion signals LK1 and LK2 may be transferred between the timing controller and the data driver.

Further, as illustrated in FIG. 8, in a case where a data driver includes a plurality of data driving circuits (or a plurality of data driving chips), LOCK flags of the data driving circuits may be set to a high level independently of one another. By accessing information of the data driving circuit of which the LOCK flag is set, the first initialization completion signal LK1 of the data driving circuit may be provided to the timing controller. Thus, the respective first initialization completion signals of the data driving chips may be provided to the timing controller in a time divisional manner, and thus the initialization completion signals may be transferred without an additional line.

Figure 9:
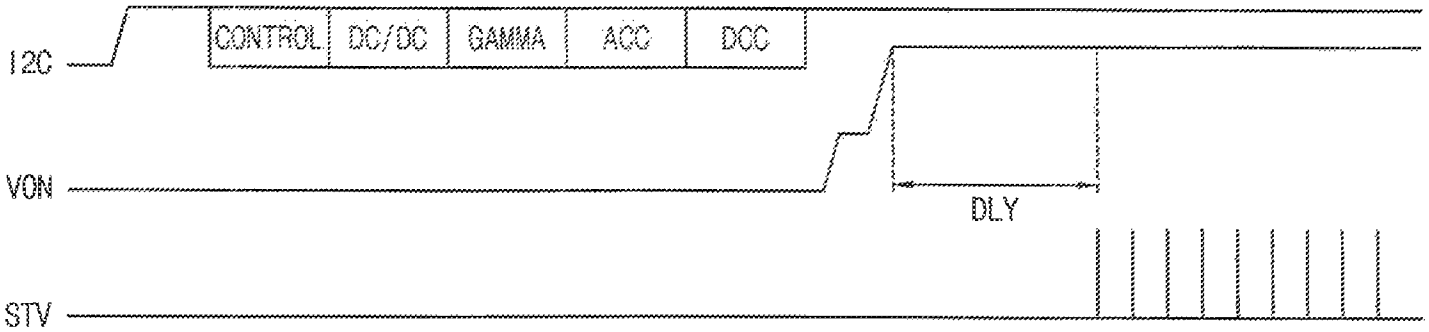
FIG. 9 is a diagram for describing an effect of the display device of FIG. 1 according to an exemplary embodiment of the present inventive concept.

FIG. 9 is a diagram for describing an effect of a display device of FIG. 1 according to an exemplary embodiment of the present inventive concept.

Referring to FIG. 9, in a display device according to an exemplary embodiment of the present inventive concept, setting register values I2C, such as a timing controller setting, a DC-DC converter setting, a gamma setting, a voltage level setting, etc., may be loaded, an input voltage VON may be supplied, and control signals (e.g., the vertical start signal STV) may be provided to operate a driver after a delay time DLY. If it is supposed that the control signals are provided before the setting register values I2C are loaded or before the input voltage VON is stably supplied, a display panel may display an abnormal image. However, in the display device according to an exemplary embodiment of the present inventive concept, since the control signals are provided to the driver after the setting register values I2C are loaded and the input voltage VON is stably supplied, a power-on sequence is properly performed, and stability may be increased.

Figure 10:
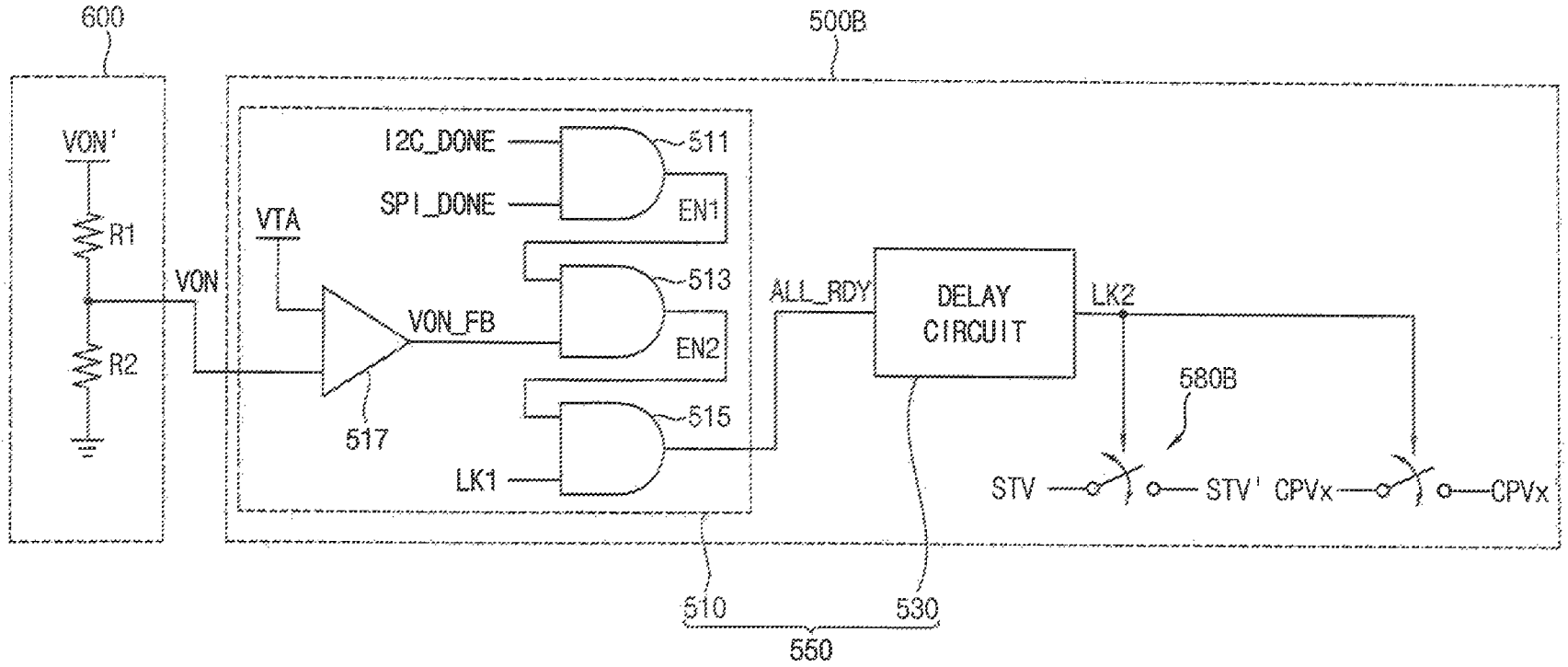
FIG. 10 is a diagram illustrating a first sequence controller included in the display device of FIG. 1 according to an exemplary embodiment of the present inventive concept.

FIG. 10 is a diagram illustrating a first sequence controller included in the display device of FIG. 1 according to an exemplary embodiment of the present inventive concept.

Referring to FIG. 10, the first sequence controller 550 of a timing controller 500B may control signals to comply with a power-on sequence by interworking with a data driver. The timing controller 500B of FIG. 10 may be substantially the same as the timing controller 500A of FIG. 2, except that the vertical start signal STV' and a gate clock signal CPVx' are output as a first control signal (e.g., CTL1). The same or similar reference numerals may be used to indicate the same or similar elements, and duplicative descriptions are omitted.

The first sequence controller 550 may include the first signal generator 510 and the delay circuit 530.

The first signal generator 510 may output the ready signal ALL_RDY based on a state signal and the first initialization completion signal LK1. In an exemplary embodiment of the present inventive concept, the first signal generator 510 may include the first AND gate 511, the second AND gate 513, the third AND gate 515, and the first comparator 517.

The delay circuit 530 may delay the ready signal ALL_RDY to increase stability of the power-on sequence.

The timing controller 500B may further include a first signal controller 580B for outputting the vertical start signal STV' and the gate clock signal CPVx' as the first control signal to a gate driver after the second initialization completion signal LK2 is activated. For example, while the second initialization completion signal LK2 is in an inactive state, the first signal controller 580B may block the vertical start signal STV' and the gate clock signal CPVx' from being outputted by using switches.

Figure 11:
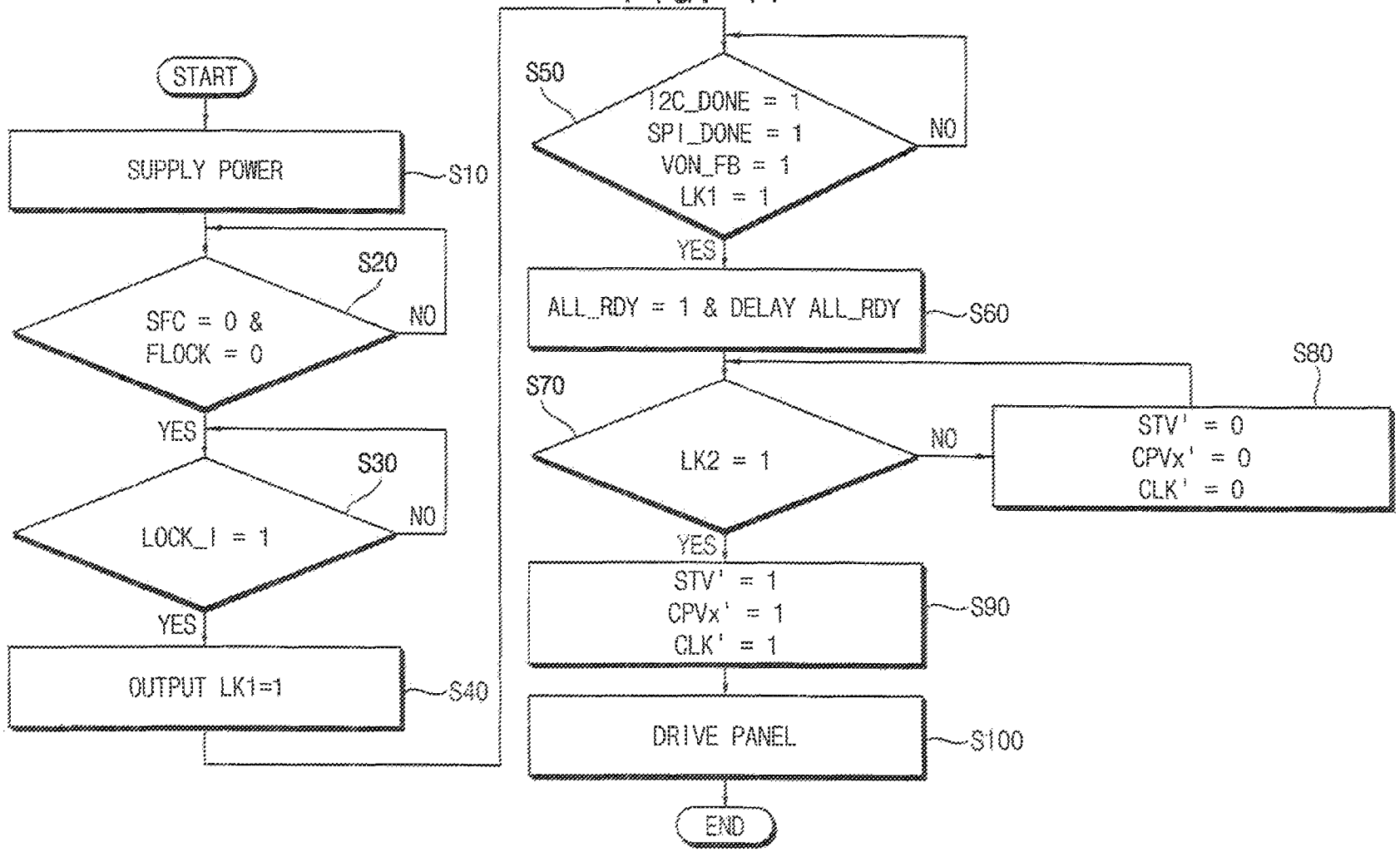
FIG. 11 is a flowchart illustrating a method of driving a display device according to an exemplary embodiment of the present inventive concept.

FIG. 11 is a flowchart illustrating a method of driving a display device according to an exemplary embodiment of the present inventive concept.

Referring to FIG. 11, a method of driving a display device according to an exemplary embodiment of the present inventive concept may provide control signals for driving the display device to a gate driver and a data driving circuit after an initialization operation of a data driver and an initialization operation of a controller, thus properly performing a power-on sequence.

The data driver may activate the first initialization completion signal LK1 after the initialization operation of the data driver is completed. For example, the display device may be supplied with power (S10), and the data driver may check whether the start frame control signal SFC from the controller and the operating flag signal FLOCK representing an operating state of the data driver have low levels (S20). The data driver may determine that the data driver is stabilized if the start frame control signal SFC and the operating flag signal FLOCK have the low levels, and may set the third enable signal LOCK_I to a high level (S30). For example, the third enable signal LOCK_I may be generated by performing a NOR operation on the start frame control signal SFC and the operating flag signal FLOCK. If the third enable signal LOCK_I is set to the high level, the data driver may output the activated first initialization completion signal LK1 to the controller (S40).

The controller may generate the second initialization completion signal LK2 based on the first initialization completion signal LK1 and a state signal activated when the initialization operation of the controller is completed. In an exemplary embodiment of the present inventive concept, the state signal may include at least one of the first signal I2C_DONE representing that a value of a setting register is loaded, the second signal SPI_DONE representing that correction data for correcting input image data are loaded, or the third signal VON_FB representing that an input voltage reaches a target voltage. For example, when all of the first signal I2C_DONE, the second signal SPI_DONE, the third signal VON_FB, and the first initialization completion signal LK1 are activated (S50), the ready signal ALL_RDY is activated, and the ready signal ALL_RDY may be delayed by a delay circuit (S60).

It may be checked whether the delayed ready signal ALL_RDY, or the second initialization completion signal LK2 is activated (S70).

Before the second initialization completion signal LK2 is activated, the controller may block outputting a first control signal (e.g., STV', CPVx'), and the data driver may block outputting a second control signal (e.g., CLK') (S80).

If the second initialization completion signal LK2 is activated, the controller may provide the first control signal (e.g., STV', CPVx') to the gate driver, and the data driver may provide the second control signal (e.g., CLK') to the data driving circuit (S90).

Thus, based on the second initialization completion signal LK2, the controller may control whether the gate driver operates. For example, while the second initialization completion signal LK2 is in an inactive state, the controller may block outputting the first control signal. However, if the second initialization completion signal LK2 is activated, the controller may provide the first control signal to the gate driver to normally generate gate signals. In an exemplary embodiment of the present inventive concept, the first control signal may include at least one of the vertical start signal STV' or the gate clock signal CPVx'.

Based on the second initialization completion signal LK2, the data driver may control outputting data signals. For example, while the second initialization completion signal LK2 is in the inactive state, the data driver may block outputting the second control signal. However, if the second initialization completion signal LK2 is activated, the data driver may output the second control signal, and may generate and provide the data signals to a display panel. In an exemplary embodiment of the present inventive concept, the second control signal may include at least one of a horizontal start signal, the data clock signal CLK', or a load signal.

The display panel may be driven by providing the gate signals and the data signals (S100).

Accordingly, the method of driving the display device may automatically control the display device to comply with a power-on sequence, and human errors may be prevented.

The present inventive concept may be applied to any electronic device including a display device. For example, the inventive concepts may be applied to a television (TV), a digital TV, a 3D TV, a smart phone, a mobile phone, a tablet computer, a personal computer (PC), a home appliance, a laptop computer, a personal digital assistant (PDA), a portable multimedia player (PMP), a digital camera, a music player, a portable game console, a navigation device, etc. For example, although exemplary embodiments of the present inventive concept where the display device is a liquid crystal display device are described above, the type of the display device may not be limited thereto.

As described above, in the display device according to exemplary embodiments of the present inventive concept, a controller may receive a signal (e.g., a first initialization completion signal) representing a stable state from a data driver, and may control a gate driver and the data driver to operate when the data driver is in the stable state. Further, the data driver may receive a signal (e.g., a second initialization completion signal) representing the stable state from the controller, and may control outputting data signals based on the received signal. Accordingly, the display device may be automatically controlled to comply with a power-on sequence, and thus delay register values for the power-on sequence need not be set.

The method of driving the display device according to exemplary embodiments of the present inventive concept may automatically control the display device to comply with the power-on sequence, and thus may prevent an abnormal display phenomenon that may be caused when the delay register values are not properly set and/or human errors of the delay register values.

While the present inventive concept has been shown and described with reference to exemplary embodiments thereof, it will be understood by those of ordinary skill in the art that various changes in form and details may be made thereto without departing from the spirit and scope of the present inventive concept as set forth by the following claims.

What is claimed is:

1. A display device comprising:

a display panel including a plurality of pixels;

a gate driver configured to provide gate signals to the plurality of pixels;

a data driver configured to generate a first initialization completion signal, and to provide data signals to the plurality of pixels; and a controller configured to generate a ready signal in response to the first initialization completion signal and a state signal, to generate a second initialization completion signal by delaying the ready signal, and to control the gate driver and the data driver in response to the second initialization completion signal, wherein the first initialization completion signal is activated when an initialization operation of the data driver is completed, and wherein the state signal is activated when an initialization operation of the controller is completed.

2. The display device of claim 1, wherein the data driver provides the data signals to the plurality of pixels after the second initialization completion signal is activated, and wherein the controller provides a first control signal to the gate driver after the second initialization completion signal is activated.

3. The display device of claim 2, wherein the state signal includes at least one of a first signal representing that a value of a setting register is loaded, a second signal representing that correction data for correcting input image data are loaded, or a third signal representing that an input voltage reaches a target voltage.

4. The display device of claim 3, wherein the controller includes:

a first signal generator configured to output the ready signal in response to the first signal, the second signal, the third signal, and the first initialization completion signal;

a delay circuit configured to generate the second initialization completion signal by delaying the ready signal; and a first signal controller configured to output the first control signal to the gate driver after the second initialization completion signal is activated.

5. The display device of claim 4, wherein the first signal generator includes:

a first AND gate configured to generate a first enable signal by performing an AND operation on the first signal and the second signal;

a first comparator configured to generate the third signal by comparing the input voltage and the target voltage;

a second AND gate configured to generate a second enable signal by performing an AND operation on the first enable signal and the third signal; and a third AND gate configured to generate the ready signal by performing an AND operation on the second enable signal and the first initialization completion signal.

6. The display device of claim 4, wherein, while the second initialization completion signal is in an inactive state, the first signal controller deactivates, as the first control signal, at least one of a vertical start signal or a gate clock signal.

7. The display device of claim 3, further comprising:

a power supply configured to adjust the input voltage to reach the target voltage using a resistor string.

8. The display device of claim 2, wherein the controller provides a second control signal to the data driver, and wherein the data driver includes:

a second signal generator configured to generate the first initialization completion signal in response to a start frame control signal for recovering a reference clock signal and an operating flag signal representing an operating state of the data driver;

a second signal controller configured to control outputting the second control signal in response to the second initialization completion signal; and a data driving circuit configured to generate the data signals in response to the second control signal received from the second signal controller.

9. The display device of claim 8, wherein, while the second initialization completion signal is in an inactive state, the second signal controller deactivates, as the second control signal, at least one of a horizontal start signal, a data clock signal, or a load signal.

10. The display device of claim 8, wherein the second signal generator includes:

a control interface configured to communicate with the controller, and to output the operating flag signal and the second control signal;

a NOR gate configured to generate a third enable signal by performing a NOR operation on the start frame control signal and the operating flag signal; and a flip-flop configured to activate the first initialization completion signal when the third enable signal is activated.

11. A display device comprising:

a display panel including a plurality of pixels;

a gate driver configured to provide gate signals to the plurality of pixels;

a data driver configured to generate a first initialization completion signal when an initialization operation of the data driver is completed, and to provide data signals to the plurality of pixels; and a controller configured to generate a ready signal in response to the first initialization completion signal and a state signal, to generate a second initialization completion signal by delaying the ready signal, and to control the gate driver and the data driver in response to the second initialization completion signal, wherein the data driver blocks the data signals while the second initialization completion signal is in an inactive state.

12. A method of driving a display device, the method comprising:

generating, by a data driver, a first initialization completion signal when an initialization operation of the data driver is completed;

generating, by a controller, a ready signal in response to the first initialization completion signal and a state signal that is activated when an initialization operation of the controller is completed;

generating, by a controller, a second initialization completion signal by delaying the ready signal; and providing, by the controller, a first control signal to a gate driver after the second initialization completion signal is activated.

13. The method of claim 12, further comprising:

outputting, by the data driver, data signals after the second initialization completion signal is activated.

14. The method of claim 13, wherein outputting the data signals includes:

blocking outputting of a second control signal while the second initialization completion signal is in an inactive state; and outputting the data signals in response to the second control signal that is output when the second initialization completion signal is activated.

15. The method of claim 14, wherein the second control signal includes at least one of a horizontal start signal, a data clock signal, or a load signal.

16. The method of claim 12, wherein the state signal includes at least one of a first signal representing that a value of a setting register is loaded, a second signal representing that correction data for correcting input image data are loaded, or a third signal representing that an input voltage reaches a target voltage.

17. The method of claim 16, wherein the ready signal is generated in response to the first signal, the second signal, the third signal, and the first initialization completion signal.

18. The method of claim 17, wherein generating the ready signal includes:

generating a first enable signal by performing an AND operation on the first signal and the second signal;

generating the third signal by comparing the input voltage and the target voltage;

generating a second enable signal by performing an AND operation on the first enable signal and the third signal; and generating the ready signal by performing an AND operation on the second enable signal and the first initialization completion signal.

19. The method of claim 17, wherein the first initialization completion signal is generated in response to a start frame control signal for recovering a reference clock signal and an operating flag signal.

20. The method of claim 12, wherein the first control signal includes at least one of a vertical start signal or a gate clock signal.

* * * * *